US006963282B1

(12) United States Patent
Yeates et al.

(10) Patent No.: US 6,963,282 B1
(45) Date of Patent: Nov. 8, 2005

(54) WIRELESS SELF-DESCRIBING BUILDINGS

(75) Inventors: Anthony J. Yeates, Redmond, WA (US); Yunqiang Zhu, Bellevue, WA (US); Timothy Belvin, Auburn, WA (US); Brendan O'Meara, Bellevue, WA (US)

(73) Assignee: Microsoft Corporation, Redmond, WA (US)

( * ) Notice: Subject to any disclaimer, the term of this patent is extended or adjusted under 35 U.S.C. 154(b) by 119 days.

(21) Appl. No.: 10/728,391

(22) Filed: Dec. 5, 2003

(51) Int. Cl.[7] ..... G08B 13/14

(52) U.S. Cl. ..... 340/572.4; 340/572.1; 340/505; 340/539.14

(58) Field of Search ..... 340/572.1, 572.4, 340/572.8, 573.1, 505, 509, 517, 539.1, 539.11, 340/539.14, 539.22, 825.49; 235/382, 385; 700/213, 217; 701/200, 207; 704/246, 251, 704/275; 341/176

(56) References Cited

U.S. PATENT DOCUMENTS 6,396,413 B2 * 5/2002 Hines et al. ..... 340/825.49
6,567,032 B1 * 5/2003 Mullaly et al. ..... 341/176
6,615,175 B1 * 9/2003 Gazdzinski ..... 704/275
6,662,077 B2 * 12/2003 Haag ..... 700/217
6,687,609 B2 * 2/2004 Hsiao et al. ..... 701/207
6,845,909 B2 * 1/2005 Knowles et al. ..... 235/385

OTHER PUBLICATIONS

Motorola Introduces WaveSoft—Fire 2.0, http://www.motorola.com/LMPS/pressreleases/wsfire0811.html, pp. 1-2.
ActiveWave, RFID Active Tags, http://www.activewaveinc.com/products_active_tags.html, pp. 1-2.
ActiveWave, RFID Technology Review, http://www.activewaveinc.com/technology_rfid_overview.html, p. 1.
U.S. Appl. No. 10/445,521, filed May 27, 2003.
U.S. Appl. No. 10/445,516, filed May 27, 2003.
U.S. Appl. No. 10/445,537, filed May 27, 2003.

* cited by examiner

*Primary Examiner*—Van T. Trieu
(74) *Attorney, Agent, or Firm*—Westman, Champlin & Kelly, P.A.

(57) ABSTRACT

A system and method are provided for wireless self-describing buildings. RFID tags are used to store information relative to a building. This information can be simple information such as a uniform resource locator, or more detailed information. Active and/or passive RFID tags can be used. Varying degrees of user access are provided. Accordingly, different users can be given access to relevant information based upon the type or identity of the user.

29 Claims, 3 Drawing Sheets

WIRELESS SELF-DESCRIBING BUILDINGS

BACKGROUND OF THE INVENTION

The present invention relates to buildings. More specifically, the present invention relates to methods and apparatus for providing information related to buildings wirelessly.

Many types of buildings, such as commercial, industrial, residential, et cetera, are sources of myriad information. Generally, this information cannot readily be consulted nor used. For example, a given residential building will be positioned on its lot in accordance with a plat map, be constructed in accordance with one or more blueprints, and have all of the amenities and features within selected and/or constructed in accordance with additional specifications set forth by either the builder or designer. Moreover, during the construction of the residential building, even information such as the location of wiring, plumbing, or any other items within the walls of the building may be important at some point after construction is completed. Additionally, some houses may have to have significant work done to deal with remedial problems. For example, a house may have to be radon-proof, thus requiring carbon filter mats to be built into the lowest floor and special ventilation installed to refresh air in the house. Another example includes diesel contamination existing under an existing house. Yet another example might involve the removal of asbestos installation and roofing. While another example includes dealing with damp and toxic mold, earthquake reinforcement, etc. The construction and/or maintenance done in order to address these problems may be included in the documentation maintained for the building. Generally, simply maintaining a complete set of all of this information in one location such that it can be consulted in the future is a daunting task. Moreover, once the house is sold, much of the information is generally not passed along to the new owner. While some of this building information may not be of great importance to future owners, it certainly would be useful.

The usefulness of building information increases substantially when viewed in the context of industrial and/or commercial buildings. Of primary importance here is information that may be required by emergency services such as police or fire departments when responding to emergencies at the building. For example, if a given industrial building catches fire, it is important for a fire department to be able to respond extremely quickly to the fire. It is also important to have detailed information regarding floor plans, the presence, nature, and quantity of any hazardous materials that may be located within the building, the location of fire exits, elevators, fire hoses/axes, fire hydrants, emergency tanoy systems, stairwells, sprinkler systems, et cetera. In these situations, the fire department will generally attempt to locate printed materials related to the building. Typically, these printed materials can consume the space of one or two arm-sized crates. In order to assist firefighters with emergency response, some have proposed software. For example, Motorola, of Schaumburg, Ill., provides software sold under the trade designation WaveSoft-Fire 2.0. This software provides in-vehicle electronic access to vital information such as building address, latitude/longitude on large-scale geographical maps, hydrant locations, and gas lines regarding a specific building. This information is generally stored by the fire department and consulted with respect to a specific building when an emergency for that building arises.

With respect to commercial buildings, many of the same concerns set forth above with respect to industrial buildings exist. Additionally, with respect to commercial buildings, it may be beneficial to be able to provide information to consumers to facilitate their shopping. For example, one way in which information is provided to consumers, is by the provision of a map or guide such as can be found in the typical shopping mall. While this information is generally helpful to consumers, it is relatively static and not easily changeable. Moreover, this information typically does not provide more detail than simply where in the mall a specific store is located, or where in the store a specific department is located.

There is a significant need for user-friendly, cost-effective, self-describing buildings. While the degree to which this has occurred in the past is generally limited to maps provided within shopping malls, new technology has provided an infrastructure that can be used advantageously to drastically change the way people interact with buildings.

SUMMARY OF THE INVENTION

A system and method are provided for wireless self-describing buildings. RFID tags are used to store information relative to a building. This information can be simple information such as a Uniform Resource Locator, or more detailed information. Active and/or passive RFID tags can be used. Varying degrees of user access are provided. Accordingly, different users can be given access to relevant information based upon the type or identity of the user.

DETAILED DESCRIPTION OF THE PREFERRED EMBODIMENTS

Figure 1:
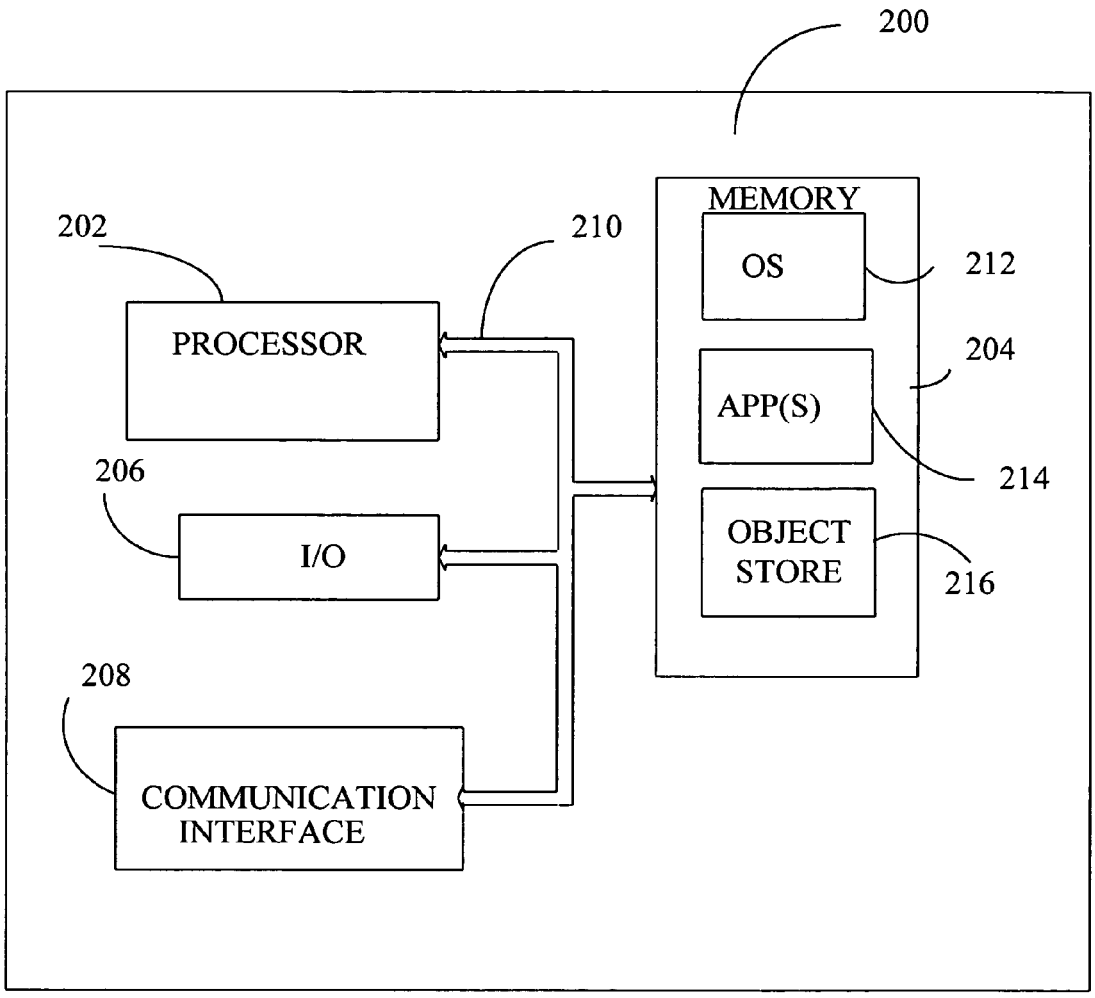
FIG. 1 is a diagrammatic view of an illustrative mobile device for interacting with RFID tags in accordance with embodiments of the present invention.

FIG. 1 is a block diagram of a mobile device 200, which is an exemplary computing environment with which embodiments of the present invention are particularly useful. Mobile device 200 could be a smartphone, tabletPC, or pocketPC. Mobile device 200 can also include a wearable PC with any suitable peripherals, such as visor-mounted peripheral displays, which can provide useable view when worn with a helmet, such as that of a firefighter. Mobile device 200 includes a microprocessor 202, memory 204, input/output (I/O) components 206, and a communication interface 208 for communicating with remote computers or other mobile devices. In one embodiment, the afore-mentioned components are coupled for communication with one another over a suitable bus 210.

Memory 204 is implemented as non-volatile electronic memory such as random access memory (RAM) with a battery back-up module (not shown) such that information stored in memory 204 is not lost when the general power to mobile device 200 is shut down. A portion of memory 204 is preferably allocated as addressable memory for program execution, while another portion of memory 204 is preferably used for storage, such as to simulate storage on a disk drive.

Memory 204 includes an operating system 212, application programs 214 as well as an object store 216. During operation, operating system 212 is preferably executed by processor 202 from memory 204. Operating system 212, in one preferred embodiment, is a WINDOWS® CE brand operating system commercially available from Microsoft Corporation. Operating system 212 is preferably designed for mobile devices, and implements database features that can be utilized by applications 214 through a set of exposed application programming interfaces and methods. The objects in object store 216 are maintained by applications 214 and operating system 212, at least partially in response to calls to the exposed application programming interfaces and methods.

Communication interface 208 represents numerous devices and technologies that allow mobile device 200 to send and receive information. The devices include wired and wireless modems, satellite receivers and broadcast tuners to name a few. Additionally, communication interface 208, in accordance with embodiments of the present invention includes an RFID transceiver. Using interface 208, can interact with RFID tags, and can also be directly connected to a computer to exchange data therewith. In such cases, communication interface 208 can be an infrared transceiver or a serial or parallel communication connection, all of which are capable of transmitting streaming information.

Input/output components 206 include a variety of input devices such as a touch-sensitive screen, buttons, rollers, and a microphone as well as a variety of output devices including an audio generator, a vibrating device, and a display. The devices listed above are by way of example and need not all be present on mobile device 200. In addition, other input/output devices may be attached to or found with mobile device 200 within the scope of the present invention.

Figure 2:
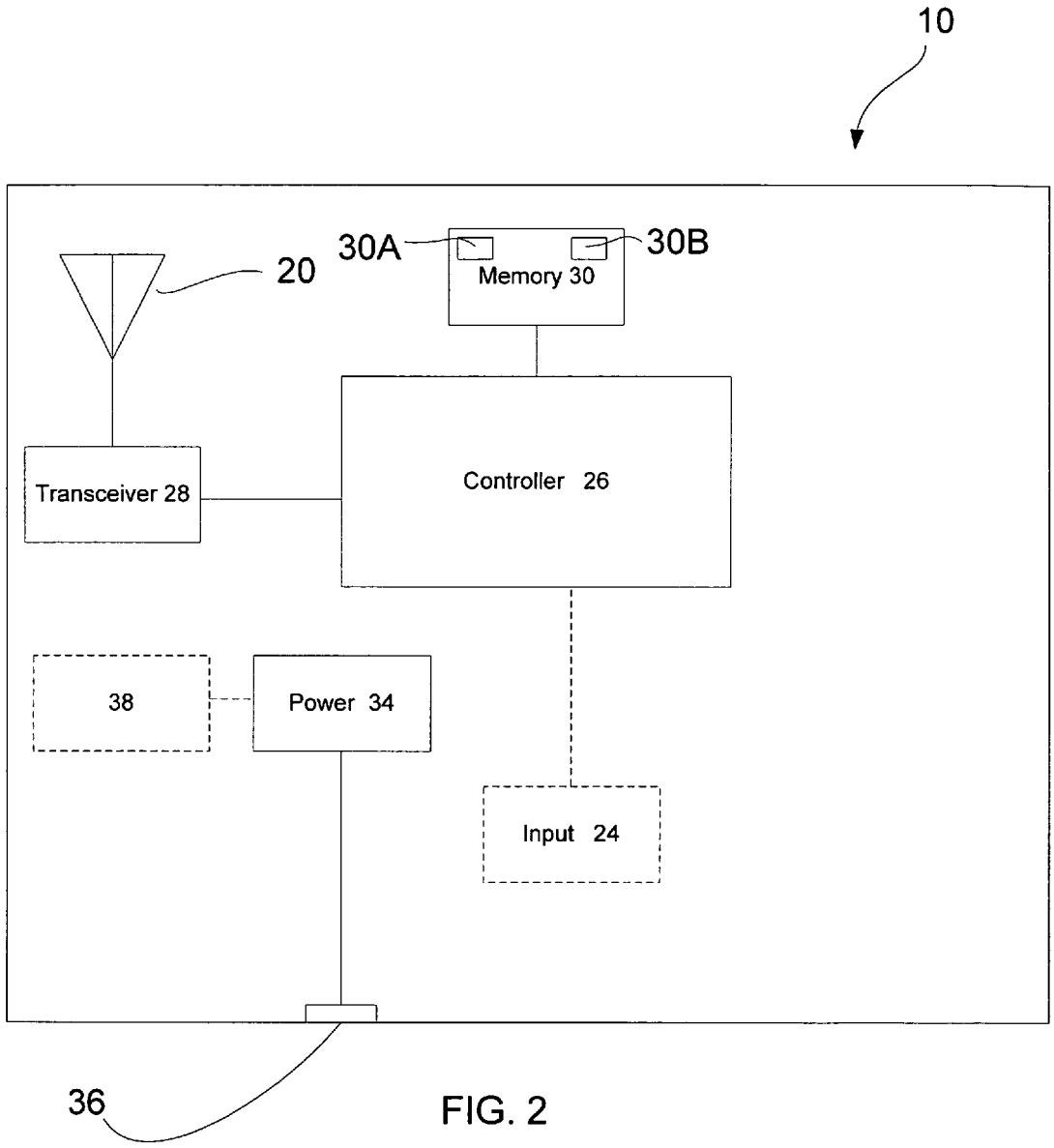
FIG. 2 is a diagrammatic view of an RFID tag with which embodiments of the present invention are particularly useful.

FIG. 2 is a simplified block diagram showing electrical components of an exemplary RFID tag 10. Tag 10 includes a controller 26, which couples to a transceiver 28 and a memory 30. Transceiver 28 couples to an antenna 20. A power source 34 is provided which is used to power electronic circuitry in RFID tag 10. Power source can comprise any device capable of receiving and/or storing energy. For example, a small battery, capacitor, or other device, which is capable of storing power for a period of time. Power source 34 can also be antenna 20 as described in greater detail later in the specification. Power source 34 includes a charger connection 36. In some embodiments, a solar power source 38 couples to power supply 34 and can be used to recharge power supply 34 as well as power the RFID tag directly.

Antenna 20 can be any type of device for receiving electromagnetic transmissions. For example, antenna 20 can be configured to receive transmissions in the range designated for "FM" broadcasts. For example, in the United States these transmissions are generally between 85 MHz and 108 MHz. However, antenna 20 can also be an inductive coupling type antenna as used with RFID tag type technology. Another example coupling technique uses capacitive or inductive coupling.

Transceiver 28 is configured to receive transmissions through antenna 20. These transmissions are typically in a digital format. The transmission can be encoded using any appropriate data transmission technique. Preferable techniques are those which have error reduction or are less susceptible to errors in transmissions. In some environments, the tag 10 may be exposed to various noise sources and the transmission technique should be robust enough to ignore noise from such sources.

Controller 26 receives data from transceiver 28. Controller 26 can be any type of controller such as a microprocessor or the like. Controller 26 preferably requires very little power to operate such that tag 10 can function for extended periods without receiving additional power. Controller 26 can comprise a customized digital integrated circuit such as an ASIC. However, in some applications, commercially available controllers can be employed.

Memory 30 can be configured to carry program instructions used for operation of controller 26. In some embodiments, these program instructions can be dynamically updated based upon data received through transceiver 28. The memory 30 can carry a more advanced operation environment such as an operating system for advanced functionality and adaptability.

Memory 30 also includes a stored address location 30A and a display data location 30B. Address location 30A contains an address which identifies tag 10. The address can uniquely identify tag 10 or can be the same as other addresses in a group of tags.

The memory 30 can be permanent memory such as ROM or EPROM, EEPROM or the like. Additionally, memory 30 can comprise volatile memory such as RAM, or a combination of volatile memory and non-volatile memory. The memory should be of appropriate size for the desired content. For example, a 1024-byte memory is sufficient to store information a Uniform Resource Identifier (URI).

Optionally, the data 30B is used by controller 26 to provide building information. This can comprise text data, graphics or their combinations. Memory 30 can also contain information such as the date of manufacture of tag 10. The variety of the nature of this information will be described in greater detail below.

Power supply 34 can be any appropriate power source. For example, a long life rechargeable battery. An optional charger connection 36 is provided to power supply 34. The power supply 34 can be periodically recharged. In some embodiments, such recharging may occur by virtue of the physical proximity of the RFID tag to electrical fields within the building. For example, with suitable inductive or capacitive coupling via antenna 20, power supply 34 may receive energy from building wiring. In another example, an optional photoelectric cell 38 is used to charge power supply 34 whenever the tag 10 is exposed to sufficient light. The ambient light of most buildings may be sufficient to recharge power supply 34 and/or power the RFID tag 10 directly. An output can be provided, for example, a signal transmitted to a remote server, which indicates that the power supply 34 needs replacement or recharging. Note, however, most RFID tags are simply powered by energy received from the reader such as mobile device 200, through antenna 20.

When transceiver 28 receives a transmission, controller 26 can interpret the digital data contained in the transmission. If the transmission is addressed to the particular tag 10, determined by comparing data in the transmission with the address stored in the address location 30A, the controller can update data stored in memory 30 as desired.

In one embodiment, transceiver 28 is configured to receive digital transmissions carried on sub-bands of normal commercial broadcast, such as broadcasts on the FM radio band. Similarly, digital data can be transmitted using low power transmitters which are only sufficient to cover a desired range, for example such that the transmission does not extend beyond the boundaries of the particular retail location.

It should be noted that RFID tags used in accordance with the present invention can be passive type or active. Passive RFID tags generally do not store any appreciable amount of electrical energy for a long period of time, but instead rely upon the transmission of electrical energy by the interrogating device (such as the portable device described with respect to FIG. 1) for energization. These devices typically have a shorter range and are generally used to authenticate personnel in, for example, sensitive or restricted areas.

In distinct contrast, active RFID devices generally have their own electrical energy source that is able to store electrical energy for a long period of time. One of the advantages of these devices is that they can have a significantly larger radio-frequency range. Commercially available active RFID devices have ranges on the order of 100–140 feet.

The manner in which information regarding a building may be embodied on or within an RFID tag can vary significantly. In one embodiment, the data may simply be a pointer such as a Uniform Resource Identifier (URI). This pointer points to a location that contains additional information about the building. For example, the pointer may be a URI that directs a browser to a web site that contains more significant amounts of data relative to the building. For RFID tags that have larger capacity memory, more significant amounts of data may be embodied locally on the RFID tag itself. For example, a digital version of a blueprint of the building may be maintained on the RFID tag. Accordingly, embodiments of the present invention extend to RFID tags containing any information that is related to a building.

Embodiments of the present invention also extend to providing varying access levels for information relative to a building. Thus, a user with a first access level may be granted access to information such as store locations within a mall, stairway locations, etc., while a second user may have access to more detailed or sensitive information such as blueprints, presence, quantity, and nature of hazardous materials, et cetera. Preferably, these varying user security levels are provided at the website or webservice that the pointer stored in the RFID tag points to. For example, when a user attempts to access the information at the website, the website can challenge the user to provide an identification in the form of a specific user identification, or an identification that identifies the user type, such as emergency response personnel, and/or provide a suitable password. This is simply one way in which varying user security levels can be provided. Another alternative is to have multiple RFID tags that respond to different frequencies. For example, one frequency may be used by emergency services, while another is used by the general public. With respect to a building such as a shopping mall, a consumer may be provided with publicly available information, while a firefighter may be provided with sensitive emergency response information. While it is conceivable that these varied levels of information access can be provided with respect to one RFID tag, it is also possible that many RFID tags may be used in conjunction with a single building.

The RFID tags can be implanted within one or more strategic locations of a building such that they achieve relative permanence with respect to the building. However, they can also be placed in accessible locations as well. Further, any combination of obscured and visible RFID tags can be used in conjunction with a single building. When RFID tags are obscured, it is preferred that they are disposed in locations such that a person who would be desirous of obtaining information on the RFID tag will be within range of the RFID tag when that person goes to a specific location that is foreseeable. For example, RFID tags providing store locations within a shopping mall may be strategically positioned at shopping mall entrances. Further, RFID tags providing information to assist in emergency response may be disposed near an emergency management panel in a building, such as a fire panel. With respect to a residence, the RFID tag may be placed within a wall in a relatively standard location, such as an entrance, or near the utility panel, for example.

Figure 3:
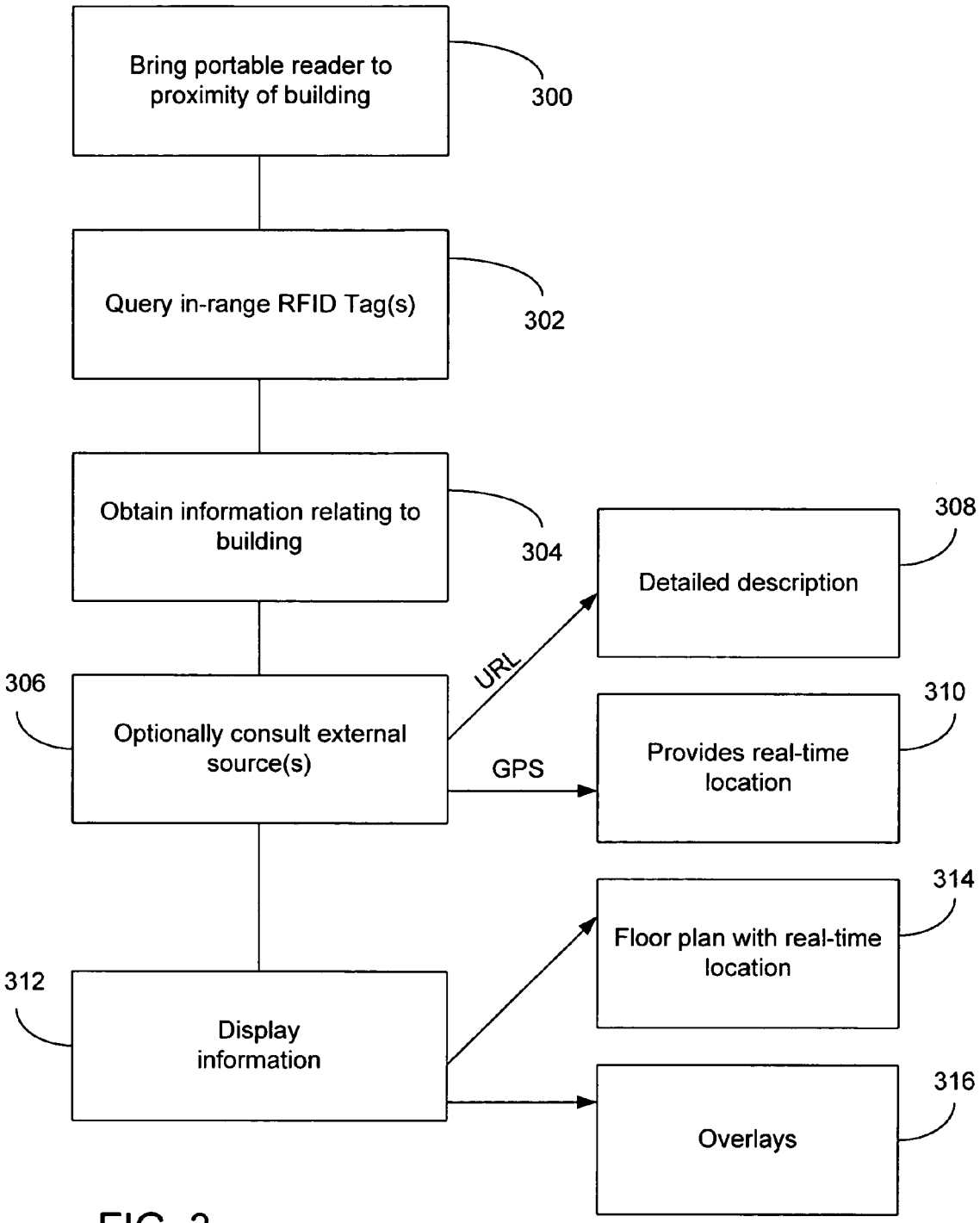
FIG. 3 is a flow diagram of a method of interacting with a self-describing building in accordance with an embodiment of the present invention.

FIG. 3 is a diagrammatic view of a method for interacting with buildings in accordance with an embodiment of the present invention. The method begins at block 300 where a portable device, such as that described with respect to FIG. 1, is brought to the vicinity of the building. As used herein, vicinity is intended to mean a location within range of at least one RFID tags relative to the building. Accordingly, the vicinity can include locations both inside and outside the building. Once step 300 is complete, step 302 can be executed wherein the portable device generates a signal to query or scan all RFID tags that are within range. Once the signal has been sent, the portable device obtains information relative to the building from at least one in-range RFID tag, indicated at block 304. As described above, this information may simply be one or more Uniform Resource Identifiers, or it may be additional information, such as floor plans, et cetera. In situations where relatively small amounts of information are obtained, optional step 306 can be performed where the portable device uses the obtained information to seek and obtain further information. For example, once having received one or more URIs, the portable device can access information sources, either stored locally within the portable device, or remotely via wireless internet means to obtain a more detailed description of the building, as indicated at block 308. In some embodiments, the portable device may also include a receiver for the Global Positioning System (GPS). In this case, the GPS receiver, can also be utilized to obtain position information of the portable device, as indicated at block 310. Location information can also be provided without using GPS. For example, the mobile device may be configured to measure the signal strength returned by several RFID tags to determine location of the mobile device with respect to the six RFID tags. If at least some of the RFID tags also contain information regarding their relative location, then this technique can provide a complete solution with respect to mobile device location. In such a case, it is desirable to essentially collaborate the RFID location system by writing location information, perhaps in the form of GPS coordinates, to one or more RFID tags based upon the location of such RFID tags. At block 312, the building information, including that obtained directly, and that obtained as a result of the building information is displayed by the portable device. This display can include illustration of the building floor plan updated periodically to illustrate real-time location of the portable device within the floor plan, as indicated at block 314. Additionally, information such as the location of hazardous materials or other similar information may be provided as one or more display overlays, as indicated at block 316, on the portable device.

The following descriptions provide further details regarding the types of building information that may be stored either directly or indirectly in an RFID tag in accordance with embodiments of the present invention. The description will be structured in terms of building types, such as residential, industrial and commercial. However, it is expressly contemplated that embodiments of the present invention are practicable with any type of building including combinations of the above types as well as types not listed herein.

Residential building information includes any or all information generated during the construction of the house. Accordingly, such information can include plat maps, surveys, copies of paperwork used in closing transactions, contracts or encumbrances related to the building, warranty information, et cetera. Additionally, the physical specification of the residential building, including blueprints, specification of amenities, such as paint, carpeting, building materials, et cetera, can also be provided. Moreover, names and locations of the suppliers of the materials used for construction can also be provided. Another type of residential building information includes descriptions or illustrations of hidden wiring and plumbing, that can be documented during construction and which is subsequently hidden when the building is finished. This information can allow easier access in the future if such items need to be modified. As the dwelling is under construction, a number of inspections are performed and the reports from these inspections, can also be stored and provided as part of the building information. This building information can also include images as well as regular and three dimensional schematics.

Industrial buildings will generally have all of the same information set forth above with respect to residential buildings. In addition, there are usually a number of additional systems and/or amenities in industrial buildings for which additional information could be provided. For example, industrial buildings will generally have an internal fire suppression system, fire exits, elevators, fire hydrant locations, and other information that is useful to emergency response personnel. This information can also include the presence, nature, quantity, and location of any hazardous materials stored in the industrial building. While this may include information regarding a hazardous material storage area, it is also conceivable that in certain embodiments where read/write RFID tags are provided, that the RFID tag or server or disk storage to which it points can be updated with specific information about specific hazardous materials as the nature, presence, quantity, or location of the hazardous materials changes. Industrial buildings also have generally more advanced HVAC systems, wiring systems, structural systems, et cetera. Embodiments of the present invention extend to any information that describes the building, whether directly or indirectly (directly being when the RFID tag contains the information itself—indirectly being when the RFID tag contains a pointer to the information). Additionally, a larger number of subcontractors are enlisted for the construction of the industrial building than a residential building. In fact, the operation of the industrial building may include a number of contractors. Information regarding contractors, including business names, addressees, phone numbers, and contact persons at the business can be stored, directly or indirectly, in an RFID tag as building information. For example, an RFID tag in an industrial building may include information regarding the contractor that provided the plumbing services during building construction, and the contractor may provide an emergency contact person, which information may be stored relative to the plumbing.

Commercial buildings can include all of the information set forth above with respect to residential buildings and industrial buildings. Additionally, commercial buildings will generally have a number of different types of persons involved therewith. Commercial buildings may have RFID information stored that is of particular interest to building owners, different RFID information stored that may be of particular importance to emergency response personnel, and still further RFID information stored for consumers. This may be provided on a single RFID tag or on multiple RFID tags. Additionally, user access levels may be varied such that a consumer accessing consumer-related RFID information will not be granted access to RFID information that is appropriate only for emergency response personnel. It is possible that different information could be available depending on whether the user is a consumer, an owner, a contractor, a governmental worker, or an emergency responder. Accordingly, a consumer with a portable device such as that illustrated with respect to FIG. 1, may enter a commercial building, such as a shopping mall, and receive consumer-appropriate building information from an RFID tag located within range of the consumer entrance. This information may include the traditionally-available map of the shopping mall showing locations of all stores therein. It may provide additional information regarding the nature of the stores, and any other information that may be of particular interest to a consumer, such as the nature of goods provided by the store, the operating hours of the store, phone number of the store, the existing and nature of any sales provided by the store, et cetera. This could also include providing a link to a hosted service/website for the store/mall. This would facilitate quick and easy updates (e.g. Santa is located here, seasonal gift wrapping located there, special discount coupons for today only, sales/specials, etc.) Users of such hosted services/websites could potentially include filters in their mobile devices, or such filters could be provided on the website, for example, to only provide information of particular interest. Additionally, further RFID tags can be provided at entrances to stores within a shopping mall such that as a consumer moves within range of the store-specific RFID tag, information can be provided to the consumer regarding the layout of the store (such as individual departments within the store, locations of checkout positions, locations of fitting rooms, restrooms, stairs, et cetera.

Embodiments of the present invention generally provided building information stored on RFID tags. The technological infrastructure for RFID tags and interaction with such tags is commercially available. Advances have been made recently with design and manufacture of RFID tags such that they are now relatively inexpensive. It is believed that the combination of RFID tag memory capacity, cost, and convergence of RFID transceivers with traditional mobile devices, such as hand-held computers will facilitate the widespread use of embodiments of the present invention. Accordingly, users of buildings will be provided with much more complete and relevant information easier than in the past.

Although the present invention has been described with reference to preferred embodiments, workers skilled in the art will recognize that changes may be made in form and detail without departing from the spirit and scope of the invention.

What is claimed is:

1. An device for providing building information wirelessly, the device comprising:

an RFID tag having memory containing building information.

2. The device of claim 1, wherein the RFID tag comprises:

a controller;

a power source coupled to the controller and being adapted to supply power to the controller;

a wireless transceiver coupled to the power source and the controller, the wireless transceiver being adapted to communicate wirelessly using radio-frequency transmission; and wherein the memory is coupled to the controller.

3. The device of claim 1, wherein the RFID tag is an active RFID tag.

4. The device of claim 1, wherein the RFID tag is a passive RFID tag.

5. The device of claim 1, wherein the building information is selectively accessible based upon a type of user accessing the information.

6. The device of claim 1, wherein the building information is selectively accessible based upon an identification of the user.

7. The device of claim 1, wherein the building information is selectively accessible based on the RF frequency of the reader.

8. The device of claim 1, wherein the building information is a pointer that points to a location of additional building information.

9. The device of claim 8, wherein the pointer is a Uniform Resource Identifier.

10. The device of claim 1, wherein the building information is residential building information.

11. The device of claim 1, wherein the building information is industrial building information.

12. The device of claim 1, wherein the building information is commercial building information.

13. The device of claim 1, wherein the building information includes emergency response information.

14. The device of claim 13, wherein the building information includes at least one digitized floor plan.

15. The device of claim 13, wherein the building information includes information related to hazardous materials.

16. The device of claim 1, wherein the building information is changeable using wireless communication with the RFID tag.

17. A system for interacting with a building, the system comprising:

at least one RFID tag disposed in a vicinity of the building, the RFID tag having building information stored therein;

a portable device having an RFID transceiver therein, the portable device configured to interact wirelessly with the at least one RFID tag to access the building information.

18. The system of claim 17, wherein the portable device changes the stored building information.

19. The system of claim 17, wherein the portable device is a handheld computing device.

20. The system of claim 19, wherein the handheld computing device includes a communication interface that allows the device to access remote information.

21. The system of claim 20, wherein the building information includes at least one Uniform Resource Identifier, and wherein the portable device obtains additional remote information based on the stored Uniform Resource Identifier.

22. The system of claim 17, wherein building information is stored at a remote location and is provided based on user credentials.

23. The system of claim 17, wherein access to the information stored in at least one RFID is selectively provided based on user type.

24. The system of claim 23, wherein user type is selected from the group consisting of: consumer, owner, contractor, governmental and emergency personnel.

25. The system of claim 17, wherein at least one RFID tag is an active RFID tag.

26. The system of claim 17, wherein at least one RFID tag is a passive RFID tag.

27. The system of claim 17, wherein at one RFID tag is hidden.

28. The system of claim 27, wherein the hidden RFID tag is disposed at a position in the building where a foreseeable user will be.

29. The system of claim 28, wherein the position is within range of an entrance.

* * * * *